US005081729A

United States Patent [19]

Menday

[11] Patent Number: 5,081,729

[45] Date of Patent: Jan. 21, 1992

[54] DISPOSABLE FITTED BIRTHING SHEET

[76] Inventor: Elisa C. Menday, P.O. Box 1024, Lebanon, N.H. 03766

[21] Appl. No.: 690,289

[22] Filed: Apr. 24, 1991

[51] Int. Cl.[5] ..... A47G 9/04

[52] U.S. Cl. ..... 5/487; 5/484; 5/496; 5/499

[58] Field of Search ..... 5/60, 482, 484, 487, 5/496, 497, 499, 500, 470

[56] References Cited

U.S. PATENT DOCUMENTS

| | | | |
|---|---|---|---|
| 3,583,009 | 6/1971 | Smith | 5/499 |
| 3,591,875 | 7/1971 | Zipf | 5/484 X |
| 3,761,973 | 10/1973 | Leventhal | 5/484 |
| 3,956,782 | 5/1976 | Morrison | 5/497 X |
| 3,989,867 | 11/1976 | Sisson | 5/484 X |
| 4,923,453 | 5/1990 | Bullard, Jr. | 5/484 X |

*Primary Examiner*—Michael F. Trettel
*Attorney, Agent, or Firm*—Michael I. Kroll

[57] ABSTRACT

A disposable fitted birthing sheet is provided for a mattress which consists of a covering having a contoured shape to fit about the mattress. A first mechanism is in the bottom surface of the covering for providing an access so that the mattress can fit into the covering. A second mechanism is in the top surface of the covering, for keeping a patient dry and infection free during a pre-birthing and birthing process.

9 Claims, 2 Drawing Sheets

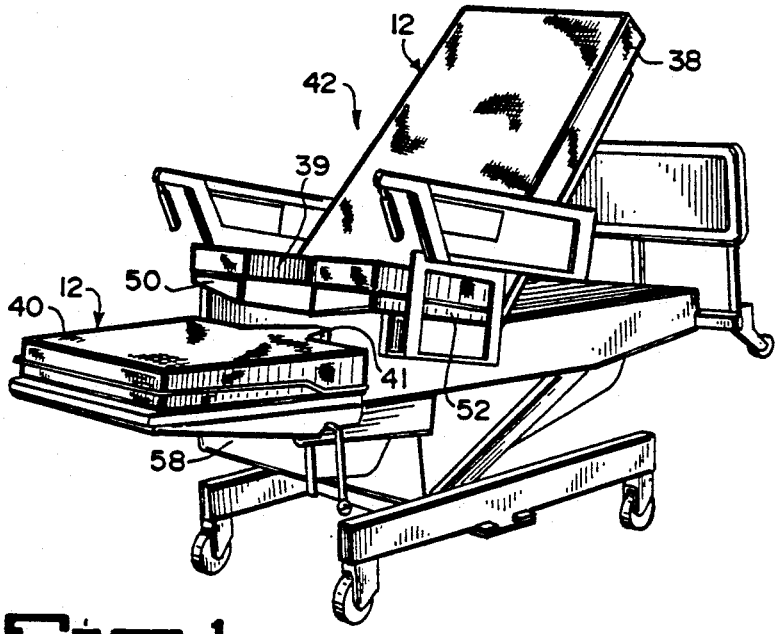
Fig. 1
Fig. 9
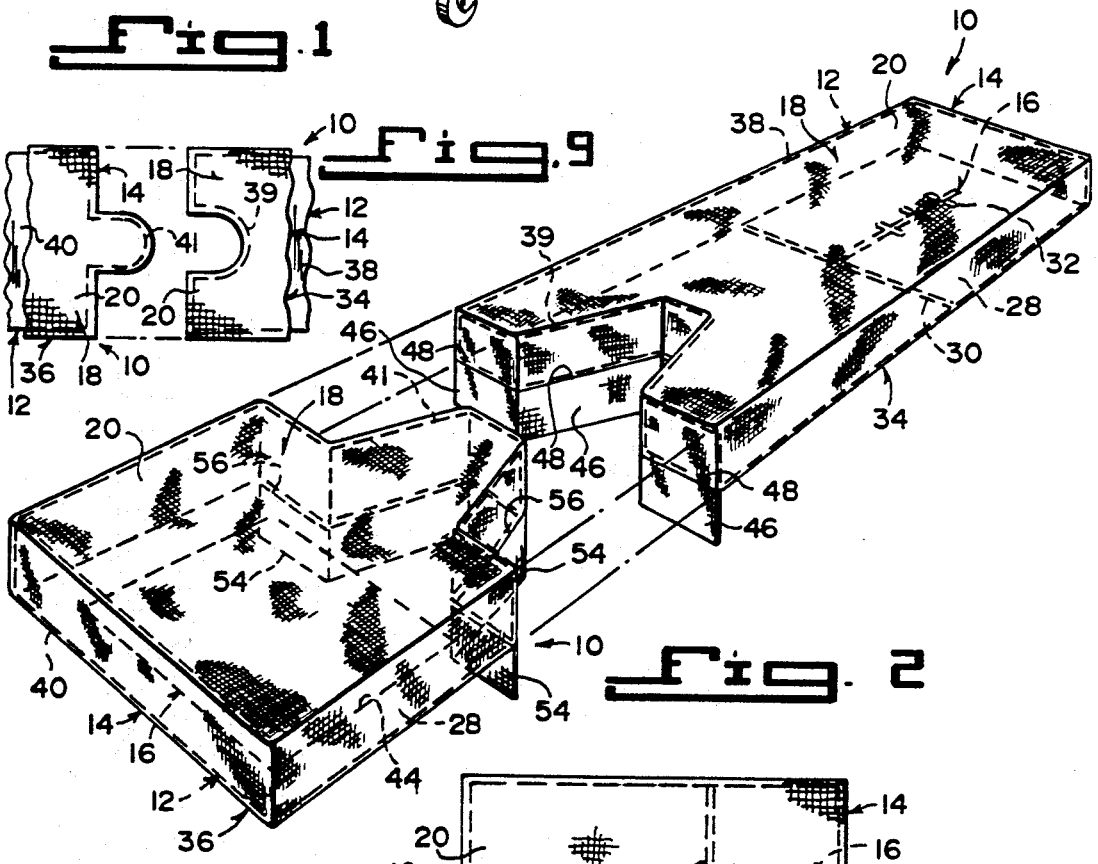
Fig. 2
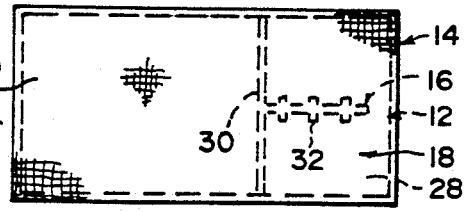
Fig. 10

Fig. 3
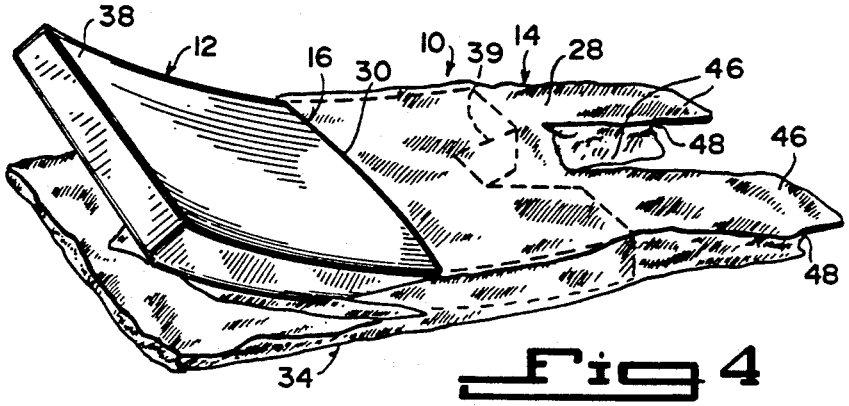
Fig. 4
Fig. 5
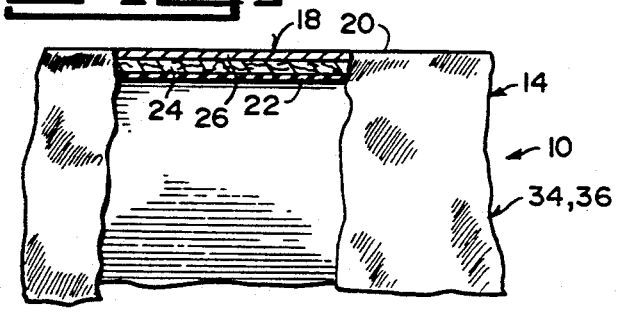
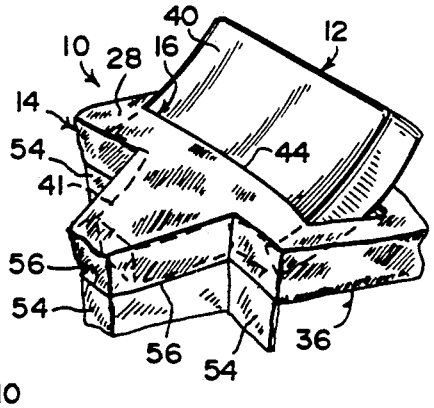
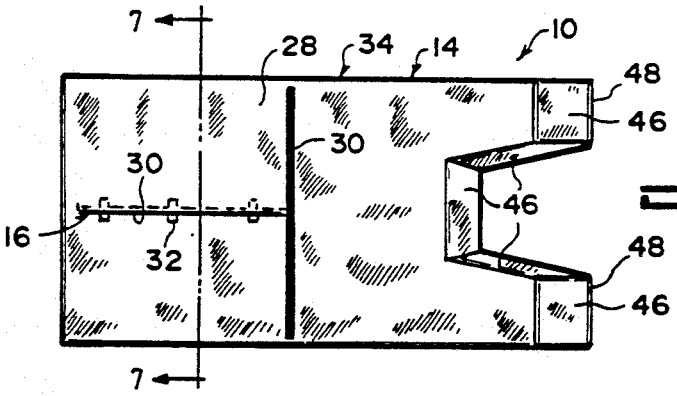
Fig. 6
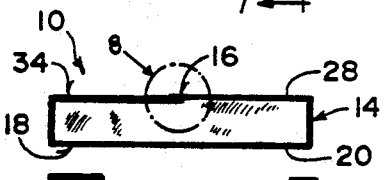
Fig. 7
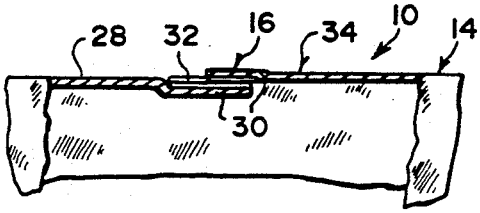
Fig. 8

DISPOSABLE FITTED BIRTHING SHEET

BACKGROUND OF THE INVENTION

1. Field of the Invention

The instant invention relates generally to fitted mattress sheets and more specifically it relates to a disposable fitted birthing sheet.

2. Description of the Prior Art

Numerous fitted mattress sheets have been provided in prior art that are adapted to include elastic material so that the fitted mattress sheets can fit snugly over the top surface of a mattress. While these units may be suitable for the particular purpose to which they address, they would not be as suitable for the purposes of the present invention as heretofore described.

SUMMARY OF THE INVENTION

A primary object of the present invention is to provide a disposable fitted birthing sheet that will overcome the shortcomings of the prior art devices.

Another object is to provide a disposable fitted birthing sheet that will keep a patient dry and infection free during a pre-birthing and birthing process.

An additional object is to provide a disposable fitted birthing sheet which is fitted, contoured and held in place with adhesive tabs so that it will remain in place when a bed is adjusted up and down.

A further object is to provide a disposable fitted birthing sheet that is simple and easy to use.

A still further object is to provide a disposable fitted birthing sheet that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view of a commercial birthing bed structure with a two piece mattress member composition.

FIG. 2 is a perspective view of the instant invention fitted over the two piece mattress member composition shown in FIG. 1.

FIG. 3 is a perspective view of the first segment of the covering with the upper adjustable head mattress member being inserted therein.

FIG. 4 is a perspective view of the second segment of the covering with the adjustable removable foot mattress member being inserted therein.

FIG. 5 is a side view with parts broken away and in section of any one of the segments showing the three different layers within the top surface thereof.

FIG. 6 is a bottom view of the first segment of the covering.

FIG. 7 is a cross sectional view taken along line 7—7 in FIG. 6.

FIG. 8 is a enlarged cross sectional view as indicated by arrow 8 in FIG. 7, showing the overlap opening and one of the self adhesive tabs in greater detail.

FIG. 9 is a top view with parts broken away showing a "U"-shaped configuration between the first and second segments of the covering instead of the "V"-shaped configuration.

FIG. 10 is a top view showing the covering on a regular hospital mattress and the like.

DETAILED DESCRIPTION OF THE PREFERRED EMBODIMENTS

Turning now descriptively to the drawings, in which similar reference characters denote similar elements throughout the several views, the Figures illustrate a disposable fitted birthing sheet 10 for a mattress 12 which consists of a covering 14 having a contoured shape to fit about the mattress 12. A first mechanism 16 is in the bottom surface 28 of the covering 14 for providing an access so that the mattress 12 can fit into the covering 14. A second mechanism 18 is in the top surface 20 of the covering 14, for keeping a patient dry and infection free during a pre-birthing and birthing process.

As best seen in FIG. 5, the second mechanism 18 includes a first lower layer 22 of impervious backing material against the top of the mattress 12, to prevent liquid from reaching the mattress 12 below. A second middle layer 24 of absorbent material is on top of the first lower layer 22 to retain the liquid therein. A third upper layer 26 of permeable material, is on top of the second middle layer 24 to allow the liquid to pass into the second middle layer 24 away from the patient and keep the top surface 20 dry.

The first lower layer 22 of impervious backing material is a waterproof sheet, such as rubber, plastic and the like. The second middle layer 24 of absorbent material is a fibrous sheet, such as cotton and the like. The third top layer 26 of permeable material is a thin membrane sheet, such as paper and the like.

The first mechanism 16 includes the bottom surface 28 of the covering 14 having a "T"-shaped overlap slot 30, so that the mattress 12 can inserted therein. A plurality of self adhesive tabs 32 are spaced apart within the "T"-shaped overlap slot 30 in the bottom surface 28 of the covering 14 to fasten the "T"-shaped overlap slot 30 in a closed position.

The covering 14 can further include a first segment 34 and a second segment 36. The first segment 34 can fit about an upper adjustable head mattress member 38 with a lower recess 39 therein. The second segment 36 can fit about an adjustable removable foot mattress member 40 with an upper projection 41 therefrom in a commercial birthing bed structure 42.

The first mechanism 16 in the second segment 36 of the covering 14 includes the bottom surface 28 of the covering 14 having a generally rectangular aperture 44 therethrough so that the adjustable removable foot mattress member 40 of the commercial birthing bed structure 42 can be inserted within the generally rectangular aperture 44.

A first flap 46 extends downwardly from the first segment 34 of the covering 14 at its lower bottom end 48 thereof so as to fit over a retaining edge 50 of a base 52 which is used to hold the upper head mattress member 38 in position in the commercial birthing bed structure 42. A second flap 54 extends downwardly from the second segment 36 of the covering 14 at its lower top end 56 thereof, so that the second flap 54 will face towards the first flap 46.

The first flap 46 and the second flap 54 are fabricated out of the same impervious backing material as the first lower layer 22, so as to direct any liquid into a catch basin 58 below, in the commercial birthing bed structure 42.

The lower recess 39 and the upper projection 41 can be a "V"-shaped configuration as shown in FIGS. 1, 2, 3 and 4, or a "U"-shaped configuration as shown in FIG. 9. The covering 14 as shown in FIG. 10 can also be utilized on a regular hospital mattress 12 and the like.

The covering 14 can be fabricated in a variety of colors, such as pastel, pastel prints and stripes. The covering 14 should be made of a material suitable for disposal by burning, because it can contain infectious waste products therein. If the covering 14 is not to be used with infectious waste, then it should be fabricated out of biodegradable materials.

Since the covering 14 is disposable, there is no chance of carry over infection and there is no requirement for costly sterile laundering. The covering 14, protects the mattress 12, saves water, saves fuel to heat the water and saves electricity, since there is no need for laundering and drying the covering 14.

The covering 14 should be made of hypoallergenic materials and be sterile for burn cases. The covering 14 can be used and sized for operating tables, ambulance stretchers, conventional baby cribs and sterile operating room drapes. The covering 14 can also be placed over a mattress of a baby stabilet unit. This unit is used immediately after birth to control the body temperature of the baby. The covering 14 will keep the baby dry and thereby retain body heat.

LIST OF REFERENCE NUMBERS

10 disposable fitted birthing sheet
12 mattress
14 covering
16 first mechanism
18 second mechanism
20 top surface of 14
22 first lower layer of 18
24 second middle layer of 18
26 third upper layer of 18
28 bottom surface of 14
30 "T"-shaped overlap slot of 16
32 self adhesive tab of 16
34 first segment of 14
36 second segment of 14
38 upper adjustable head mattress member
39 lower recess in 38
40 adjustable removable foot mattress member
41 upper projection on 40
42 commercial birthing bed structure
44 generally rectangular aperture in 36
46 first flap
48 lower bottom end of 34
50 retaining edge in 42
52 base in 42
54 second flap
56 lower top end of 36
58 catch basin in 42

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation ca be made by those skilled in the ar without departing in any way from the spirit of the present invention.

Without further analysis, the foregoing will so fully reveal the gist of the present invention that others can, by applying current knowledge readily adapt it for various applications without omitting features that, from the standpoint of prior art, fairly constitute essential characteristics of the generic or specific aspects of this invention.

What is claimed is new and desired to be protected by Letters Patent is set forth in appended claims:

1. A disposable fitted birthing sheet for a mattress which comprises:

a) a covering having a contoured shape to fit about the mattress;

b) means in the bottom surface of said covering for providing an access so that the mattress can fit into said covering, said access means includes the bottom surface of said covering having a "T"-shaped overlap slot so that the mattress can be inserted therein, and a plurality of self adhesive tabs spaced apart within the bottom surface of said covering to fasten the "T"-shaped overlap slot in a closed position;

c) means in the top surface of said covering, for keeping a patient dry and infection free during a prebirthing and birthin process.

2. A disposable fitted birthing sheet as recited in claim 1, wherein said keeping dry means includes:

a) a first lower layer of impervious backing material against the top of the mattress to prevent liquid from reaching the mattress below;

b) a second middle layer of absorbent material on top of said first lower layer to retain the liquid therein; and c) a third upper layer of permeable material on top of said second middle layer to allow the liquid to pass into said second middle layer away from the patient and keep the top surface dry.

3. A disposable fitted birthing sheet a recited in claim 2, wherein said first lower layer of impervious backing material is a waterproof sheet.

4. A disposable fitted birthing sheet a recited in claim 3, wherein said second middle layer of absorbent material is a fibrous sheet.

5. A disposable fitted birthing sheet as recited in claim 4, wherein said third top layer of permeable material is a thin membrane sheet.

6. A disposable fitted birthing sheet as recited in claim 5, wherein said covering further includes a first segment and a second segment so that said first segment can fit about an upper adjustable head mattress member with a lower recess therein and said second segment can fit about an adjustable removable foot mattress member with an upper projection therefrom in a commercial birthing bed structure.

7. A disposable fitted birthing sheet as recited in claim 6, wherein said access means in said second segment of said covering includes the bottom surface of said covering having a generally rectangular aperture therethrough so that the adjustable removable foot mattress member of the commercial birthing bed structure can be inserted within the generally rectangular aperture.

8. A disposable fitted birthing sheet as recited in claim 7, further including:

a) a first flap extending downwardly from said first segment of said covering at its lower bottom end thereof so as to fit over a retaining edge of a base which is used to hold the upper head mattress member in position in the commercial birthing bed structure; and b) a second flap extending downwardly from said second segment of said covering at its lower top end thereof so that said second flap will face towards said first flap.

9. A disposable fitted birthing sheet as recited in claim 8, wherein said first and second flaps are fabricated out of said same impervious backing material as said first lower layer so as to direct any liquid into a catch basin below, in the commercial birthing bed structure.

* * * * *